US006261196B1

(12) United States Patent
Caruso

(10) Patent No.: US 6,261,196 B1
(45) Date of Patent: Jul. 17, 2001

(54) RELEASABLE/BREAK-AWAY SPORTS GOAL

(76) Inventor: Anthony Caruso, Kwik Goal Ltd., 140 Pacific Dr., Quakertown, PA (US) 18951

( * ) Notice: Subject to any disclaimer, the term of this patent is extended or adjusted under 35 U.S.C. 154(b) by 0 days.

(21) Appl. No.: 09/267,131

(22) Filed: Mar. 10, 1999

(51) Int. Cl.[7] ..... A63B 63/00
(52) U.S. Cl. ..... 473/476; 473/446; 256/70
(58) Field of Search ..... 473/476, 477, 473/471, 478; 273/127 B

(56) References Cited

U.S. PATENT DOCUMENTS

| | | | | |
|---|---|---|---|---|
| 2,525,304 | * | 10/1950 | Lindsay | 473/478 |
| 3,979,120 | | 9/1976 | Dietrich . | |
| 4,420,158 | * | 12/1983 | Klock et al. | 473/478 |
| 4,721,306 | | 1/1988 | Shewchuk . | |
| 5,039,100 | * | 8/1991 | Cortese | 273/127 B |
| 5,464,207 | | 11/1995 | Boitano . | |
| 5,539,957 | | 7/1996 | Schmidt . | |
| 5,681,231 | | 10/1997 | Reeves . | |
| 5,820,497 | * | 10/1998 | Pena | 473/471 |

* cited by examiner

*Primary Examiner*—Jeanette Chapman
*Assistant Examiner*—M. Chambers
(74) *Attorney, Agent, or Firm*—Richard L. MIller, P.E.

(57) ABSTRACT

A sports goal for minimizing injury to a player striking thereupon that includes a frame and a net that extends across the frame. The frame is tubular and includes four posts that extend vertically upwardly from a surface, at four corners of an imaginary rectangle, a front cross member that extends horizontally across the uppermost ends of a forwardmost pair of posts of the four posts of the frame. The forwardmost pair of posts of the four posts of the frame are releasably attached to the front cross member of the frame, which allows the forwardmost pair of posts of the four posts of the frame to break away from the front cross member of the frame when struck by the player for preventing injury thereto, while the remainder of the frame remains erect. Each end of the front cross member of the frame has a pin that depends therefrom that is releasably received in a blind bore that extends axially in the uppermost ends of the forwardmost pair of posts of the four posts of the frame.

5 Claims, 1 Drawing Sheet

FIG. 1
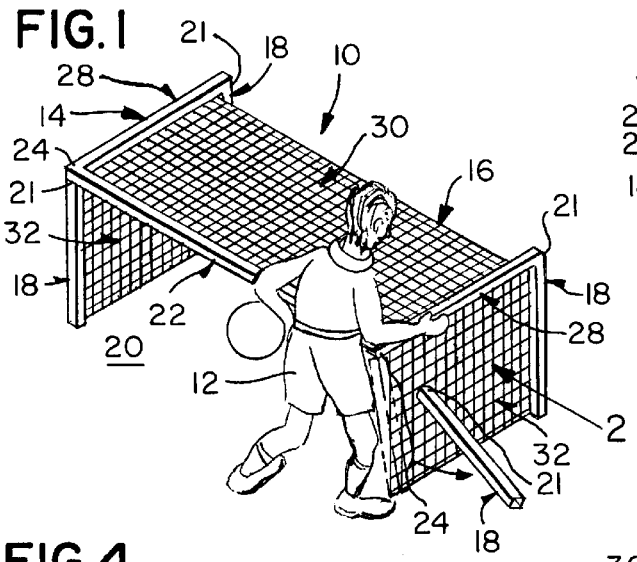
FIG. 2
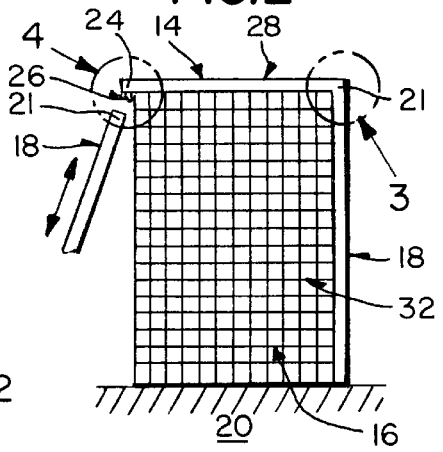
FIG. 4
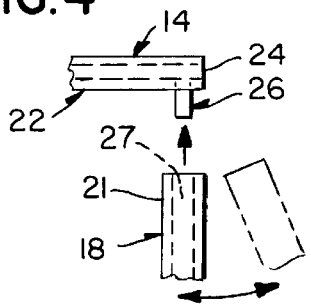
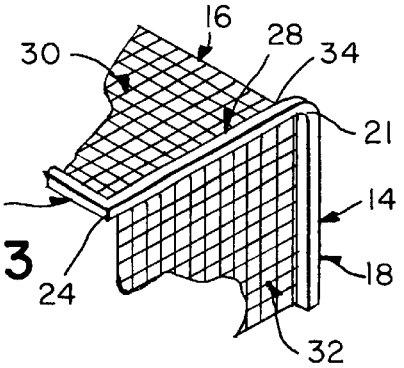
FIG. 3
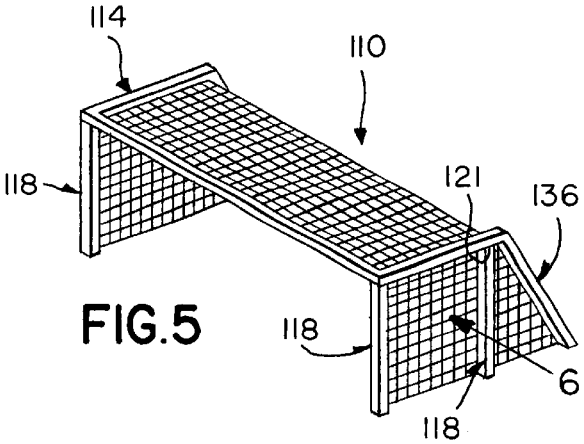
FIG. 5
FIG. 6
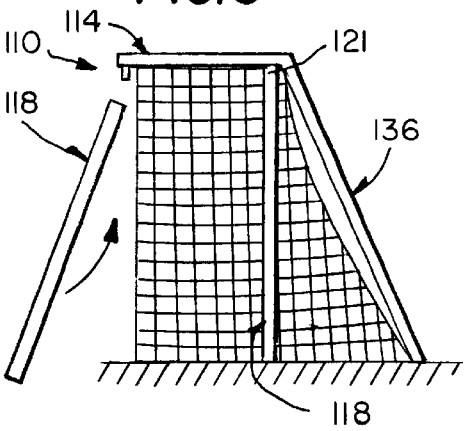

RELEASABLE/BREAK-AWAY SPORTS GOAL

BACKGROUND OF THE INVENTION

1. Field of the Invention

The present invention relates to a sports goal. More particularly, present invention relates to a sports goal for minimizing injury to a player striking thereupon.

2. Description of the Prior Art

Numerous innovations for sports goals have been provided in the prior art that will be described. Even though these innovations may be suitable for the specific individual purposes to which they address, however, they differ from the present invention.

A FIRST EXAMPLE, U.S. Pat. No. 3,979,120 to Dietrich teaches a frame for supporting a games net that includes a number of tubular frame members having threaded ends and a number of helical springs that are threadably connectable to the threaded ends to form a novel frame structure that is restorable deformable at the joined ends.

A SECOND EXAMPLE, U.S. Pat. No. 4,721,306 to Shewchuk teaches a goal structure for a game such as ice hockey that provides a safety net which is constructed in the conventional form to provide a rigid pair of posts and cross-bar together with net supports extending rearwardly of the posts. The goal structure can be attached to the playing surface or ice hockey an assembly mounted wholly within the posts comprising a spring and cable, the cable passing axially of the post through an apertured guide block at the end of the post into an anchor bolt within the ice. An upper end of the spring is movable axially to apply and release the spring tension either by a transverse pin which extends into slots in the wall of the post or by an axial pin which can be held in a tensioned position by a latch. The anchor bolt in the ice allows the post to slide sideways across the ice. A plug can be placed in the ice surface when the post is removed to prevent water entering the fixture when flooding.

A THIRD EXAMPLE, U.S. Pat. No. 5,464,207 to Boitano teaches a basketball goal for use with a basketball backboard having a front surface that has a rigid annular rim which is normally disposed horizontally during play and a rigid metal plate fixed to the rigid annular rim and extending rearwardly therefrom in coplanar relationship thereto. The goal includes a mounting bracket having at least a back wall and a top wall mounted on the front surface of the backboard by the back wall and pivotally connected to the rigid metal plate. The rigid metal plate is pivotally connected to the bracket to thereby permit the rigid metal plate and rigid annular rim fixed thereto to pivot in relation to the backboard. The releasable latching mechanism is rollably interconnected to the rigid metal plate and to the mounting bracket and permits tilting of the rigid annular rim from the normally horizontal play position thereof only when force of at least a certain preselected amount is placed upon the rigid annular rim. The rigid annular rim immediately returns to the normal horizontal play position after the latching means has been released and the force causing such release has been removed.

A FOURTH EXAMPLE, U.S. Pat. No. 5,539,957 to Schmidt teaches a mesh net supporting framework for a hockey goal which is readily collapsed for transportation or storage that has elongated tubular members hinged together at their respective ends and locking mechanisms at those hinges for securing the tubular members in mutually perpendicular configurations. The locking mechanisms may comprise an elbow with one of the tubular members and a short tube extending therefrom perpendicular to one another. There is an abutment on the short tube, and a cylindrical cuff surrounds the other of the tubular members, with that cuff having a semi-cylindrical extension for engaging the abutment. The other tubular member also has a semi-cylindrical end portion for engaging the abutment. Relative angular movement of the tubular members is precluded when the semi-cylindrical end and the semi-cylindrical extension are misaligned, while the tubular members are relatively angularly movable when the semi-cylindrical extension are positioned adjacent the same semicircular portion of the abutment. The locking mechanisms are freed to collapse the goal by rotating the cuff through about one hundred eighty degrees about the other tubular member.

A FIFTH EXAMPLE, U.S. Pat. No. 5,681,231 to Reeves teaches a collapsible game goal, such as for lacrosse, that has joints at the intersections of the uprights with the crossbar and the lower frame members. The net is configured such that a portion of the net is installed inside the frame members. The goal can therefore be easily collapsed, such as for transport to a different location. The goal can then be easily put in place, by unfolding the frame members.

It is apparent that numerous innovations for sports goals have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a sports goal for minimizing injury to a player striking thereupon that avoids the disadvantages of the prior art.

ANOTHER OBJECT of the present invention is to provide a sports goal for minimizing injury to a player striking thereupon that is simple and inexpensive to manufacture.

STILL ANOTHER OBJECT of the present invention is to provide a sports goal for minimizing injury to a player striking thereupon that is simple to use.

BRIEFLY STATED, YET ANOTHER OBJECT of the present invention is to provide a sports goal for minimizing injury to a player striking thereupon that includes a frame and a net that extends across the frame. The frame is tubular and includes four posts that extend vertically upwardly from a surface, at four corners of an imaginary rectangle, a front cross member that extends horizontally across the uppermost ends of a forwardmost pair of posts of the four posts of the frame. The forwardmost pair of posts of the four posts of the frame are releasably attached to the front cross member of the frame, which allows the forwardmost pair of posts of the four posts of the frame to break away from the front cross member of the frame when struck by the player for preventing injury thereto, while the remainder of the frame remains erect. Each end of the front cross member of the frame has a pin that depends therefrom that is releasably received in a blind bore that extends axially in the uppermost ends of the forwardmost pair of posts of the four posts of the frame.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows:

FIG. 1 is a diagrammatic perspective view of a first embodiment of the present invention in use;

FIG. 2 is an enlarged diagrammatic side elevational view taken generally in the direction of arrow 2 in FIG. 1;

FIG. 3 is a diagrammatic perspective view of the area generally enclosed by the dotted curve identified by arrow 3 in FIG. 2;

FIG. 4 is an enlarged diagrammatic perspective view of the area generally enclosed by the dotted curve identified by arrow 4 in FIG. 2;

FIG. 5 is a diagrammatic perspective view of a second embodiment of the present invention; and FIG. 6 is an enlarged diagrammatic side elevational view taken generally in the direction of arrow 6 in FIG. 5.

LIST OF REFERENCE NUMERALS UTILIZED IN THE DRAWING

Preferred Embodiment

10 sports goal for minimizing injury to a player striking thereupon of the present invention
12 player
14 frame
16 net
18 four posts of frame 14 for extending vertically upwardly from surface 20, at four corners of imaginary rectangle
20 surface
21 uppermost ends of four posts 18 of frame 14
22 front cross member of frame 14
24 pair of ends of front cross member 22 of frame 14
26 pin depending from each end of pair of ends 24 of front cross member 22 of frame 14
27 blind bore in uppermost ends 21 of forwardmost pair of posts of four posts 18 of frame 14
28 pair of side cross members of frame 14
30 top portion of net 16
32 pair of side portions of net 16
34 rear portion of net 16

Alternate Embodiment

110 sports goal for minimizing injury to a player striking thereupon of the present invention
118 four posts of frame 114
121 uppermost ends of pair of rearwardmost posts of four posts
118 of frame 114
136 pair of braces of frame 114

DETAILED DESCRIPTION OF THE PREFERRED EMBODIMENT

Referring now to the figures, in which like numerals indicate like parts, and particularly to FIG. 1, the sports goal for minimizing injury to a player striking thereupon of the present invention is shown generally at 10 for minimizing injury to a player 12 striking thereupon.

The configuration of the sports goal for minimizing injury to a player striking thereupon 10 can best be seen in FIGS. 1–4, and as such, will be discussed with reference thereto.

The sports goal for minimizing injury to a player striking thereupon 10 comprises a frame 14 and a net 16 extending across the frame 14.

The frame 14 is tubular and comprises four posts 18 for extending vertically upwardly from a surface 20, at four corners of an imaginary rectangle, and have uppermost ends 21.

The frame 14 further comprises a front cross member 22 that extends horizontally across the uppermost ends 21 of a forwardmost pair of posts of the four posts 18 of the frame 14 and has a pair of ends 24, with the forwardmost pair of posts of the four posts 18 of the frame 14 being releasably attached to the front cross member 22 of the frame 14, which allows the forwardmost pair of posts of the four posts 18 of the frame 14 to break away from the front cross member 22 of the frame 14 when struck by the player 12 for preventing injury thereto, while the remainder of the frame 14 remains erect.

Each end of the pair of ends 24 of the front cross member 22 of the frame 14 has a pin 26 that depends therefrom that is releasably received in a blind bore 27 that extends axially in the uppermost ends 21 of the forwardmost pair of posts of the four posts 18 of the frame 14.

The frame 14 further comprises a pair of side cross members 28 that extend fixedly and horizontally rearwardly, respectively, from the pair of ends 24 of the front cross member 22 of the frame 14 fixedly to a rearwardmost pair of posts of the four posts 18 of the frame 14.

The net 16 comprises a top portion 30 that extends across the pair of side cross members 28 of the frame 14 to the front cross member 22 of the frame 14.

The net 16 further comprises a pair of side portions 32 that extend, respectively, across a pair of sidemost posts of the four posts 18 of the frame 14, respectively, to the pair of side cross members 28 of the frame 14.

The net 16 further comprises a rear portion 34 that extends across the pair of rearwardmost posts of the four posts 18 of the frame 14, to the top portion 30 of the net 14.

The configuration of an alternate embodiment of the sports goal for minimizing injury to a player striking thereupon 110 of the present invention can best be seen in FIGS. 5 and 6, and as such, will be discussed with reference thereto.

The sports goal for minimizing injury to a player striking thereupon 110 is identical to the sports goal for minimizing injury to a player striking thereupon 10, with the addition of a pair of braces 136 that extend rearwardly incliningly, respectively, from the uppermost ends 121 of the pair of rearwardmost posts of the four posts 118 of the frame 114.

It will be understood that each of the elements described above, or two or more together, may also find a useful application in other types of constructions differing from the types described above.

While the invention has been illustrated and described as embodied in a sports goal for minimizing injury to a player striking thereupon, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A sports goal for minimizing injury to a player striking thereupon, comprising:

a) a frame; said frame being tubular and comprising:

i) four posts for extending vertically upwardly from a surface, at four corners of an imaginary rectangle, and having uppermost ends;

ii) a front cross member extending horizontally across said uppermost ends of a forwardmost pair of posts of said four posts of said frame, and having a pair of ends, with said forwardmost pair of posts of said four posts of said frame being releasably attached to said front cross member of said frame allowing said forwardmost pair of posts of said four posts of said frame to break away from, said front cross member of said frame when struck by the player for preventing injury thereto, while remainder of said frame remaining erect; each end of said pair of ends of said front cross member of said frame having a pin depending therefrom being releasably received in a blind bore extending axially in said uppermost ends of said forwardmost pair of posts of said four posts of said frame so as to allow said forwardmost pair of posts of said four posts or said frame to release when struck during play; and ii) a pair of side cross members extending fixedly and horizontally rearwardly, respectively, from said pair of ends of said front cross member of said frame, fixedly to a rearwardmost pair of posts of said four posts of said frame; and b) a net extending across said frame.

2. The goal as defined in claim 1, wherein said net comprises a top portion that extends across said pair of side cross members of said frame, to said front cross member of said frame.

3. The goal as defined in claim 2, wherein said net further comprises a rear portion that extends across said pair of rearwardmost posts of said four posts of said frame, to said top portion of said net.

4. The goal as defined in claim 1, wherein said net further comprises a pair of side portions that extend, respectively, across a pair of sidemost posts of said four posts of said frame, respectively, to said pair of side cross members of said frame.

5. The goal as defined in claim 1, wherein said frame further comprises a pair of braces that extend rearwardly incliningly, respectively, from said uppermost ends of said pair of rearwardmost posts of said four posts of said frame.

* * * * *